United States Patent [19]

DeKay

[11] Patent Number: 4,713,734

[45] Date of Patent: Dec. 15, 1987

[54] WALL LAMPS

[76] Inventor: Thomas J. DeKay, 355 NE. Elm Ter., Pinecrest Lakes, Jensen Beach, Fla. 34957

[21] Appl. No.: 934,500

[22] Filed: Nov. 24, 1986

[51] Int. Cl.[4] ..... F21S 1/02

[52] U.S. Cl. ..... 362/147; 362/432

[58] Field of Search ..... 362/145, 147, 152, 410, 362/413, 414, 431, 432, 427; 248/218.4; 339/22 R

[56] References Cited

U.S. PATENT DOCUMENTS

| | | | |
|---|---|---|---|
| 2,311,986 | 2/1943 | Henschel | 362/410 |
| 2,667,571 | 1/1954 | Versen | 362/427 |
| 2,952,829 | 9/1960 | Grohsgal | 339/22 R |
| 3,631,235 | 12/1971 | Odermann et al. | 362/410 |
| 3,868,080 | 2/1975 | Olson | 248/218.4 |
| 4,217,629 | 8/1980 | Russell | 362/147 |
| 4,317,164 | 2/1982 | Karaktin | 362/410 |

*Primary Examiner*—Samuel Scott
*Assistant Examiner*—Noah Kamen
*Attorney, Agent, or Firm*—Alvin S. Blum

[57] ABSTRACT

A wall lamp assembly includes an elongate hollow conduit carrying and concealing electric current-carrying wires. Supported at the upper end of the conduit is an electrical lamp fixture which may include a bulb and socket, reflector, and switch. Affixed to the lower end of the conduit is an electric plug. Included are means for attaching the device to a vertical surface above the electric outlet in which the plug is inserted.

20 Claims, 6 Drawing Figures

WALL LAMPS

This invention relates to wall lamps and more particularly to light fixtures attachable to a wall having an electric current-carrying conduit with a lamp at one end and an electric plug at the opposite end.

BACKGROUND OF THE INVENTION

Lighting fixtures for attaching to walls have generally provided means for attaching the lamp supporting structure to a wall along with a flexible electrical cord depending from the fixture. The cord generally terminates in a plug adapted for insertion into an electrical outlet for supplying the lamp with electrical power. Alternatively, the wiring connected to the lamp is within a conduit concealed within the walls to overcome the esthetic and functional objections to a wire dangling from a light fixture where it may trip the unwary, or be pulled out from the outlet. The wall lamp of Graziani U.S. Pat. No. 2,806,941 provides a rigid channel that is fastened to an electrical outlet box by screws and provides for connecting the wire within the channel with the wire supplying the outlet box, which requires the services of an electrician.

SUMMARY OF THE INVENTION

Wall lamps of the invention comprise an elongate conduit for carrying electrical conductors having two opposing ends. A first end terminates in a lamp fixture and a second end terminates in an electrical plug adapted for plugging into a conventional electrical outlet. The electrical conductors within the conduit are electrically connected to the lamp fixture at the first end and are electrically connected to the electrical plug at the second end. The wall lamp of the invention can thereby be installed by simply plugging the plug end into a wall outlet with the conduit extending upward therefrom without the requirement of any electrical wiring skills. Wall attaching means are provided in the conduit and/or the lamp fixture for affixing the lamp to the wall. Attaching means may include pressure sensitive adhesives, Velcro TM ,asteners, snaps, spring clamps, screws, nails and the like. The lamp fixture may hold one or more incandescent or fluorescent bulbs.

An on/off switch may be included in the conduit or lamp fixture. A night light may be included in addition to the conventional lamp. An electrical outlet may be included in the conduit. The lamp fixture may be closely applied to the wall or may extend out from the wall in the form of a bracket fixture. The lamp may have a fixed structure or it may be adapted for variably directing the light. It may include a fluorescent or incandescent bulb or the like.

It is an object of the invention to provide a lamp that can be relatively permanently installed without special tools or skills.

It is a further object to provide a lamp that does not take up space within a room.

It is a further object to provide a lamp that has no dangerous or unsightly dangling cords.

It is a further object to provide a lamp that is difficult to steal from a hotel room.

It is a further object to provide a lamp that is not easily knocked over.

It is a further object to provide a lamp that requires no furniture for support.

These and other objects and advantages of the invention will become evident from the following detailed description of the presently preferred embodiments thereof with reference to the appended drawing in which:

DETAILED DESCRIPTION OF PREFERRED EMBODIMENTS

Figure 1:
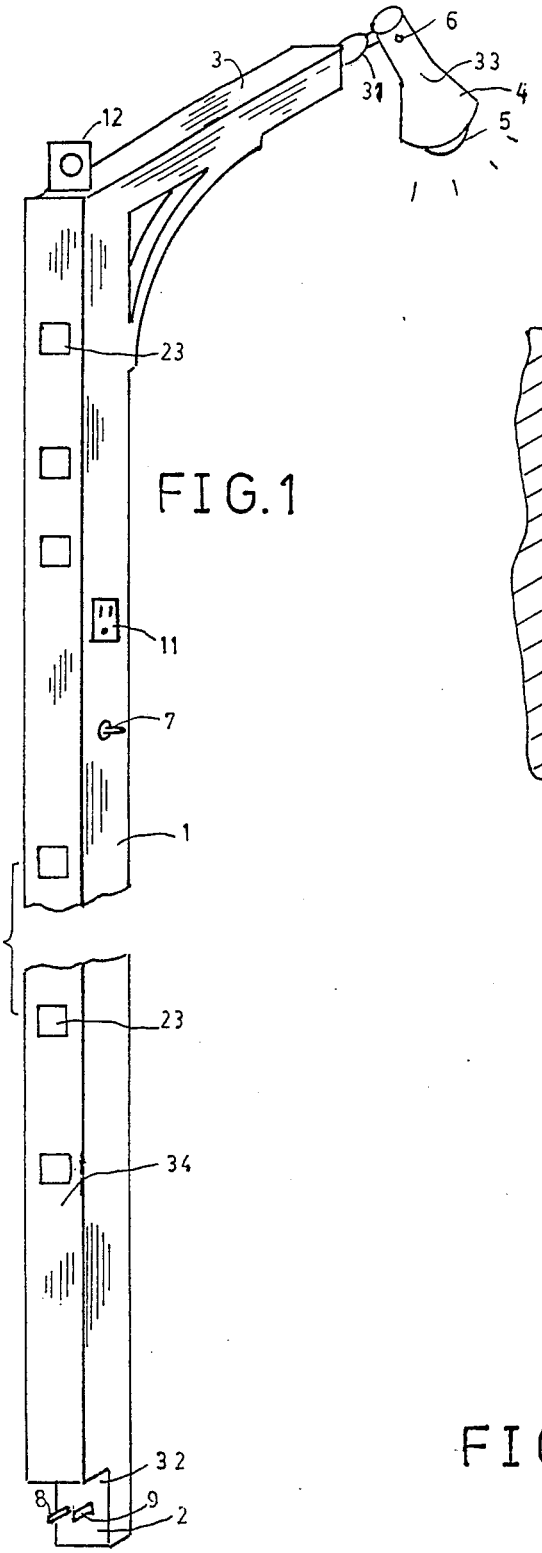
FIG. 1 is a perspective view of the invention with a directable bracket type light fixture.

In the wall lamp as shown in perspective in FIG. 1, an elongate, substantially rigid, conduit 1 supports a lamp fixture 3 at its upper end and an electrical plug 2 at its lower end. The lamp fixture 3 is of the bracket type extending outward from the wall. It carries lamp socket 33 and reflector 4 with angular adjustment 31 to direct the light emitted from bulb 5.

Figure 3:
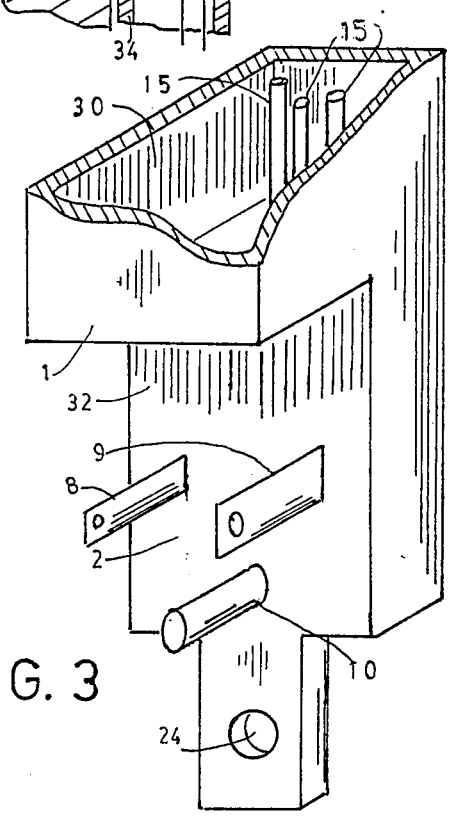
FIG. 3 is a perspective view of a plug portion with a screw receiving element.

On/off switch 6 at the lamp socket or on/off switch 7 at the conduit may be used to control electric power to the lamp. The plug 2 at the lower end of conduit 1 has prongs 8 and 9 fixed in position adapted to plug into the standard electrical wall outlet. It is shown in detail in FIG. 3 where it is seen that the conduit provides an internal space 30 containing the electric current carrying wires 15. The wires 15 connect the prongs 8,9 of the plug to the bulb receptacle 33 via the ON/OFF switches. The prongs may be polarized as shown with one larger than the other to correspond to standard practice. The plug may include ground prong 10. A screw receiving portion 24 may depend from the plug in such fashion as to be transfixed by a screw fitting into the hole between the two electrical receptacles of a standard duplex wall outlet that is adapted for retaining the cover plate over the outlet. The plug 2 has offset 32 providing space for the outward projection of the wall outlet so that the rear surface 34 of conduit 1 may fit flush against the wall. The device may optionally include convenience electric outlet 11.

Figure 2:
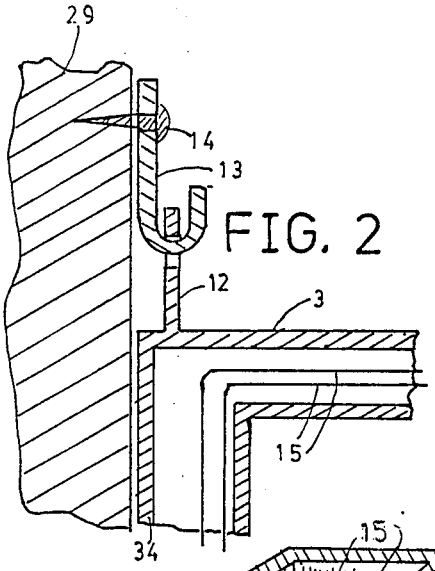
FIG. 2 is a cross section detail of the wall attaching element of FIG. 1.
Figure 5:
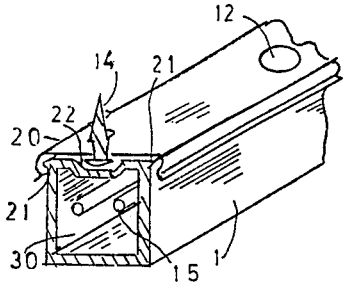
FIG. 5 is a perspective view of a conduit portion with spring clip attaching means.
Figure 6:
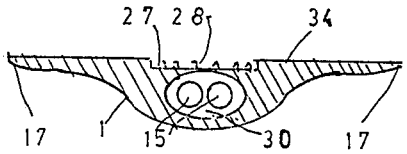
FIG. 6 is a cross sectional view of a conduit with feather edges.

A variety of means may be employed to fasten the device to the wall. A projection 12 at the top of the channel may receive a nail or a screw. As shown in FIG. 2, the projection 12 may be offset from the wall slightly and adapted to receive wall hook 13 fastened to wall 29 by screw 14. In this application, the device is first hung from the hook and the plug end 2 is then pushed into the electrical outlet. The device cannot be lifted off the hook until it is unplugged. Other wall attaching means 23 include adhesives, Velcro TM fasteners and the like. FIG. 5 shows a spring clip element 20 attachable to a wall or other vertical surface such as furniture with screws 14 in screwholes 12, the conduit 1 then snaps into place in the spring clip 20 and is held in place by projections 21. The portion of rear surface 34 of the conduit 1 that is to be against the wall may be of less thickness, or absent, it may include recess 22 providing clearance for the fastening screw, or other wall attaching means. The shape of the conduit may be varied to suit particular purposes. FIG. 6 shows a conduit with thin edges 17 and recess 27 holding Velcro TM fastener 28 for fitting snug against a wall. When the conduit is painted or papered over to match the wall, it is well concealed.

Figure 4:
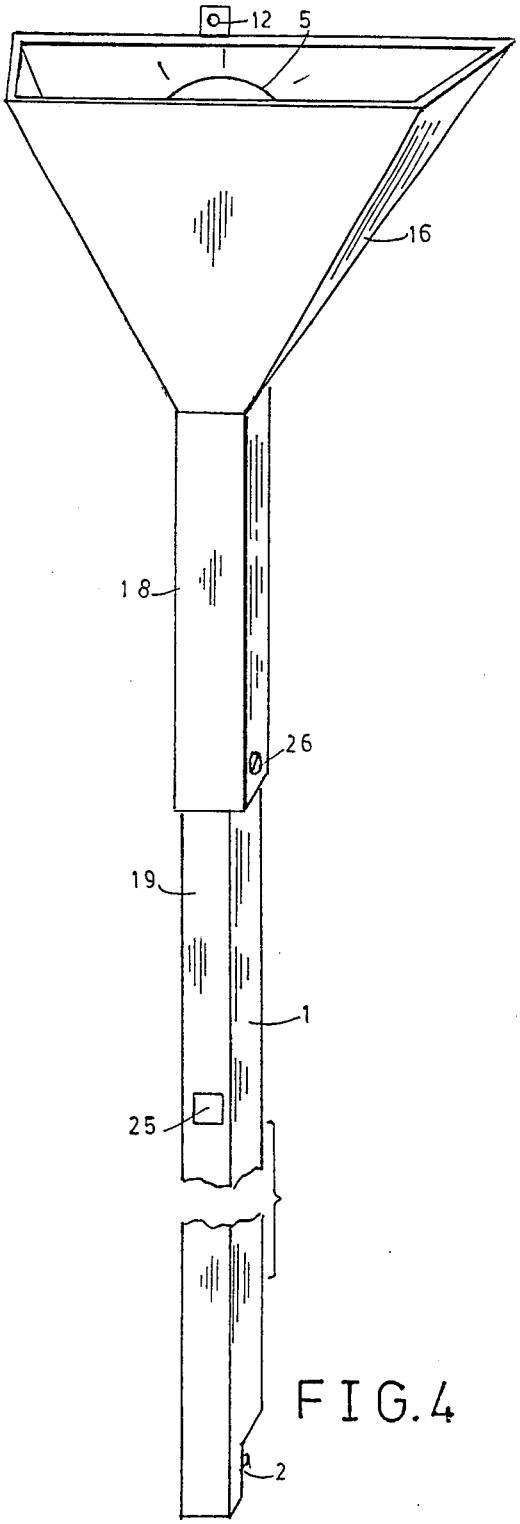
FIG. 4 is a perspective view of a telescoping embodiment of the invention.

FIG. 4 shows another embodiment of the invention wherein the conduit is comprised of two telescoping parts, an inner member 19 carrying the plug 2 and an optional nightlight 25 in the front surface of conduit 1, and the outer member 18 which carries the sconce type fixed light fixture 16 and is adapted to slide over member 19 to adjust the distance between light fixture 16 and plug 2 to suit a particular application. Locking screw 26 fixes the two members. Sufficient clearance is provided in the inner conduit space for the extra wire required. The device may be constructed of wood, plastic, metal and combinations thereof and suitably finished for attractive appearance.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A wall lamp assembly which mounts an electric light on a planar vertical surface without exposed electric wiring, comprising:

(a) elongate conduit means having a front surface and a rear surface for carrying and concealing from view electric wires for supplying electric power to said electric light;

(b) electric light support means connected to the upper end of said conduit means, including at least one electric light socket means electrically connected to said wires for supplying electric power to said electric light;

(c) electric plug means connected to, and supported by, the lower end of said conduit means, said plug means electrically connected to said wires and adapted for plugging into an electric outlet;

(d) wall attaching means connected to said conduit means for attaching said assembly to said vertical surface; said plug means including prongs extending beyond said rear surface of said conduit means for electrically engaging a wall-mounted electric outlet when said conduit means is attached to said planar vertical surface.

2. The apparatus of claim 1, wherein said wall attaching means is connected to said electric light support means.

3. The apparatus of claim 1, wherein said plug means is polarized.

4. The apparatus of claim 1, wherein said plug means includes a ground pin.

5. The apparatus of claim 1, including on/off switch means between said plug and said electric light.

6. The apparatus of claim 1, said conduit means including at least two members arranged to slidably telescope one within the other to provide adjustment of the distance between said plug means and said light socket means.

7. The apparatus of claim 1, including extending means in said light support means for extending said light socket means away from said vertical surface.

8. The apparatus of claim 1, said light support means including adjustable light directing means for directing the beam of light emitted from said electric light.

9. The apparatus of claim 1, said plug means including screw receiving means for receiving a screw that will also hold a faceplate over said electric outlet and that will secure said plug to said outlet.

10. The apparatus of claim 1, wherein said conduit means has thin lateral edges to reduce its visibility.

11. The apparatus of claim 1, wherein said conduit means is substantially rigid.

12. The apparatus of claim 1, wherein said conduit means is made substantially of wood.

13. The apparatus of claim 1, wherein said conduit means is made substantially of plastic.

14. The apparatus of claim 1, wherein said conduit means is made substantially of metal.

15. The apparatus of claim 1, wherein said conduit means includes at least one electric outlet.

16. The apparatus of claim 1, wherein said conduit means includes a low intensity light of the night light variety.

17. In the apparatus of claim 1, said attaching means includes attaching means selected from the group consisting of spring clips, snaps, adhesives, hook and loop fasteners of the VELCRO TM type, and nail, screw and hook receiving elements.

18. In the apparatus of claim 2, said attaching means includes attaching means selected from the group consisting of spring clips, snaps, adhesives, hook and loop fasteners of the VELCRO TM type, and nail, screw and hook receiving elements.

19. A wall lamp assembly which mounts an electric light on a planar vertical surface without exposed electric wiring, comprising:

(a) elongate conduit means for applying to a vertical surface and for carrying and concealing from view electric wires for supplying electric power to said electric light, said conduit means having a rear surface to applying to said vertical surface;

(b) electric light support means connected to the upper end of said conduit means, including at least one electric light socket means, said light socket means electrically connected to said wires for supplying electric power to said electric light;

(c) electric plug means connected to, and supported by, the lower end of said conduit means, said plug means electrically connected to said wires and adapted for plugging into an electric outlet;

(d) wall attaching means connected to said assembly for attaching said assembly to said vertical surface, said plug means affixed to said conduit means with the prong elements of said plug means substantially at right angles to the longitudinal axis of said conduit means and extending beyond said rear surface for engaging a wall mounted electric outlet when said conduit means is applied to said vertical surface.

20. A wall lamp assembly which mounts an electric light on a planar vertical surface without exposed electric wiring, comprising:

(a) elongate conduit means for applying to a vertical surface and for carrying and concealing from view electric wires for supplying electric power to said electric light, said conduit means having a rear surface for applying to said vertical surface;

(b) electric light support means connected to the upper end of said conduit means, for supporting electric light socket means;

(c) electric plug means connected to, and supported by, the lower end of said conduit means, said plug means electrically connected to said wires and adapted for plugging into an electric outlet;

(d) wall attaching means connected to said assembly for attaching said assembly to said vertical surface, said plug means affixed to said conduit means with the prong elements of said plug means substantially at right angles to the longitudinal axis of said conduit means and extending beyond said rear surface for engaging a wall mounted electric outlet when said conduit means is applied to said vertical surface.

* * * * *